US010219607B2

(12) United States Patent
Russell et al.

(10) Patent No.: US 10,219,607 B2
(45) Date of Patent: Mar. 5, 2019

(54) METHOD AND APPARATUS FOR ENCLOSING

(71) Applicant: Idea Boxx, LLC

(72) Inventors: Denise Russell, Pittsford, NY (US); Jeffrey Cahoon, Williamson, NY (US)

(73) Assignee: United Sources Sought, Inc., Victor, NY (US)

( * ) Notice: Subject to any disclaimer, the term of this patent is extended or adjusted under 35 U.S.C. 154(b) by 388 days.

(21) Appl. No.: 14/924,267

(22) Filed: Oct. 27, 2015

(65) Prior Publication Data

US 2017/0113853 A1 Apr. 27, 2017

(51) Int. Cl.
*A45F 3/00* (2006.01)
*A45C 1/00* (2006.01)

(52) U.S. Cl.
CPC . *A45F 3/00* (2013.01); *A45C 1/00* (2013.01)

(58) Field of Classification Search
CPC ..... B65D 53/02; B65D 55/16; B65D 85/70; B65D 33/16
USPC ..... 220/319, 521, 522, 256.1, 254.1, 212, 220/694; 206/204
See application file for complete search history.

(56) References Cited

U.S. PATENT DOCUMENTS 2,607,383 A 8/1952 Christophersen
5,851,072 A * 12/1998 LaFleur ..... B65D 77/065 383/66
5,853,247 A * 12/1998 Shroyer ..... B01L 3/505 383/106
5,900,085 A 5/1999 Clarey et al.
5,956,881 A 9/1999 Dehm
6,119,853 A 9/2000 Garrill et al.
6,315,112 B1 11/2001 Garrill et al.
6,390,291 B1 5/2002 Garrill et al.
6,578,731 B1 6/2003 Lewis et al.
6,854,888 B1 * 2/2005 Brown ..... A45F 3/20 222/107
7,083,063 B2 * 8/2006 Lien ..... B65D 33/06 220/291
7,398,891 B2 * 7/2008 Yang ..... A45F 3/20 215/306

(Continued)

FOREIGN PATENT DOCUMENTS

WO 0102266 A1 1/2001

OTHER PUBLICATIONS

Website: http://www.over-board.com.au/waterproof-iphone-case-aqua.html (dated Jul. 26, 2015) 2 pages.

(Continued)

*Primary Examiner* — Kareen K Thomas
(74) *Attorney, Agent, or Firm* — Alfred Y. Chu, Esq.; Brian B. Shaw, Esq.; Harter Secrest & Emery LLP

(57) ABSTRACT

Presented are an apparatus and method for enclosing. An exemplary apparatus includes a bag having at least a first opening and a second opening, the bag comprising a first sheet coupled to a second sheet along a periphery of the first sheet and the second sheet, and a first closing device coupled to the first opening, the first closing device able to repeatedly open and seal the first opening. The apparatus further includes a second closing device coupled to the second opening, the second closing device able to repeatedly open and seal the second opening.

17 Claims, 7 Drawing Sheets

(56) References Cited

U.S. PATENT DOCUMENTS

Figure 1:
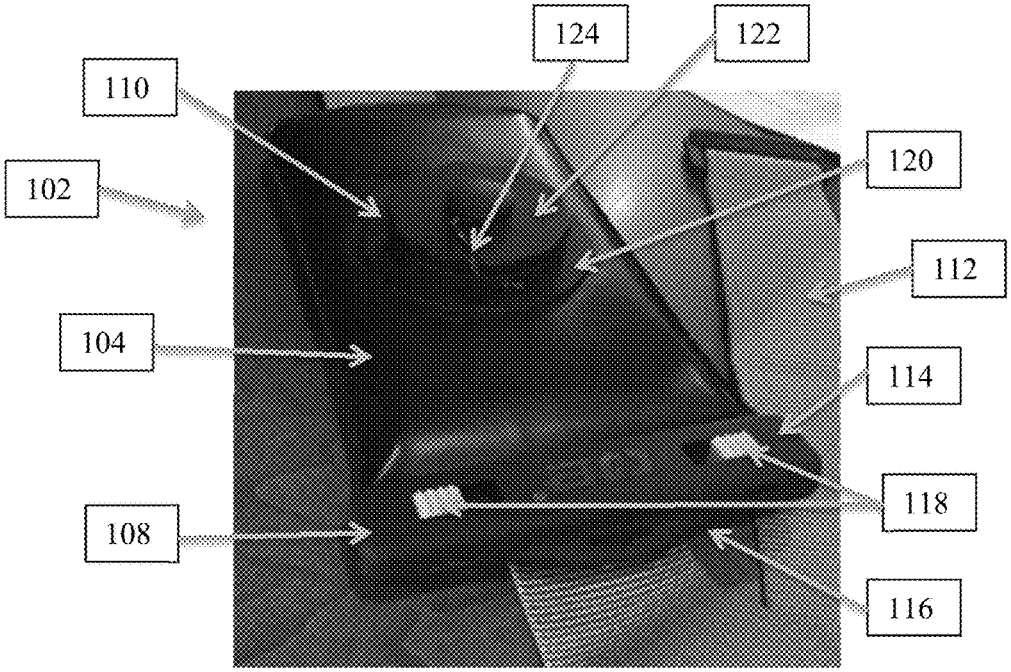

| | | | |
|---|---|---|---|
| 2003/0209453 | A1 | 11/2003 | Herman |
| 2006/0144726 | A1 | 7/2006 | Wu et al. |
| 2006/0144733 | A1 | 7/2006 | Wu et al. |
| 2010/0205909 | A1 | 8/2010 | Zimmerman et al. |

OTHER PUBLICATIONS

International Search Report and Written Opinion of the International Searching Authority in corresponding International Application No. PCT/US2016/058927 dated Feb. 17, 2017 (12 pages).

* cited by examiner

METHOD AND APPARATUS FOR ENCLOSING

BACKGROUND OF THE INVENTION

Field of the Invention

The present disclosure relates to a method and apparatus for enclosing a product. The present disclosure relates more specifically to a method and apparatus for enclosing from the elements.

Description of Related Art

A bag or sack is a common tool in the form of a non-rigid container. Bags are ubiquitous with many people routinely carrying a wide variety of them in the form of cloth or leather briefcases, handbags, and backpacks, and with bags made from more disposable materials such as paper or plastic being used for shopping. A bag may be closable by a zipper, snap, or fastener or simply by folding.

An empty bag may or may not be very light and foldable to a small size. If it is, this is convenient for carrying it to the place where it is needed, such as a shop, and for storage of empty bags. Bags vary in size from small purses to large suitcases.

BRIEF SUMMARY OF THE INVENTION

In view of the foregoing, it is an object of the present disclosure to provide a method and apparatus for enclosing.

A first exemplary embodiment of the present disclosure provides an apparatus. The apparatus includes a bag having at least a first opening and a second opening, the bag comprising a first sheet coupled to a second sheet along a periphery of the first sheet and the second sheet, and a first closing device coupled to the first opening, the first closing device able to repeatedly open and seal the first opening. The apparatus further includes a second closing device coupled to the second opening, the second closing device able to repeatedly open and seal the second opening.

A second exemplary embodiment of the present disclosure provides a method. The method includes loading a bag through a first opening and a first closing device with a plurality of items, the bag having at least the first opening and a second opening, the bag comprising a first sheet coupled to a second sheet along a periphery of the first sheet and the second sheet. The method further includes removing at least one of the plurality of items maintained within the bag through the second opening and a second closing device.

A third exemplary embodiment of the present disclosure provides an apparatus. The apparatus includes a first sheet surface, and a second sheet surface, a portion of a periphery of the first sheet surface and the second sheet surface coupled together to define an open pocket between the first sheet surface and the second sheet surface, and wherein a portion of the periphery of the first sheet surface and the second sheet surface is not coupled together defining a passage to the open pocket. The apparatus further includes a port on one of the first sheet or the second sheet; the port including a collar with at least two locking protrusions, the port defining a second passage to the open pocket, and a cap, the cap having a ring with locking troughs for locking with the at least two locking protrusions, the collar and the cap able to repeatedly open and seal the second passage. The apparatus further includes a closing device, the closing device coupled to the first sheet surface and the second sheet surface, the closing device able to repeatedly open and seal the passage.

A fourth exemplary embodiment of the present disclosure provides an apparatus. The apparatus includes a container having a hollow center and flexibly opposing walls, the container having a first opening and a second opening, the first opening and the second opening providing a passage to the hollow center, and a first closure device coupled to the first opening, the first closure device operable to open and seal the first opening. The apparatus further includes a second closure device coupled to the second opening, the second closure device operable to open and seal the second opening.

A fifth exemplary embodiment of the present disclosure provides an apparatus. The apparatus includes a cap, the cap comprising a top portion and a bottom portion, the bottom portion having a pocket, and a self-contained dispensable material, the self-contained dispensable material able to be maintained within the pocket, the self-contained dispensable material comprising moisture absorbing powder. The apparatus further including a bottom cap, the bottom cap operable to open and seal the self-contained dispensable material within the pocket.

The following will describe embodiments of the present disclosure, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

FIG. 1 provides a top perspective view of a device suitable for use in exemplary embodiments of this disclosure.

Figure 2:
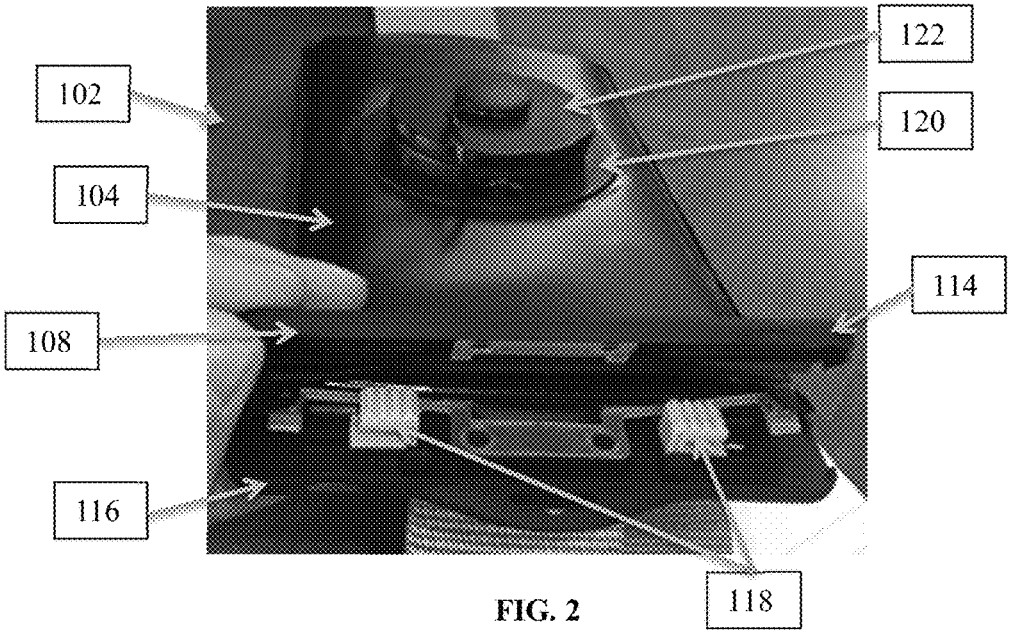

FIG. 2 provides another top perspective view of the device suitable for use in exemplary embodiments of this disclosure.

Figure 3:
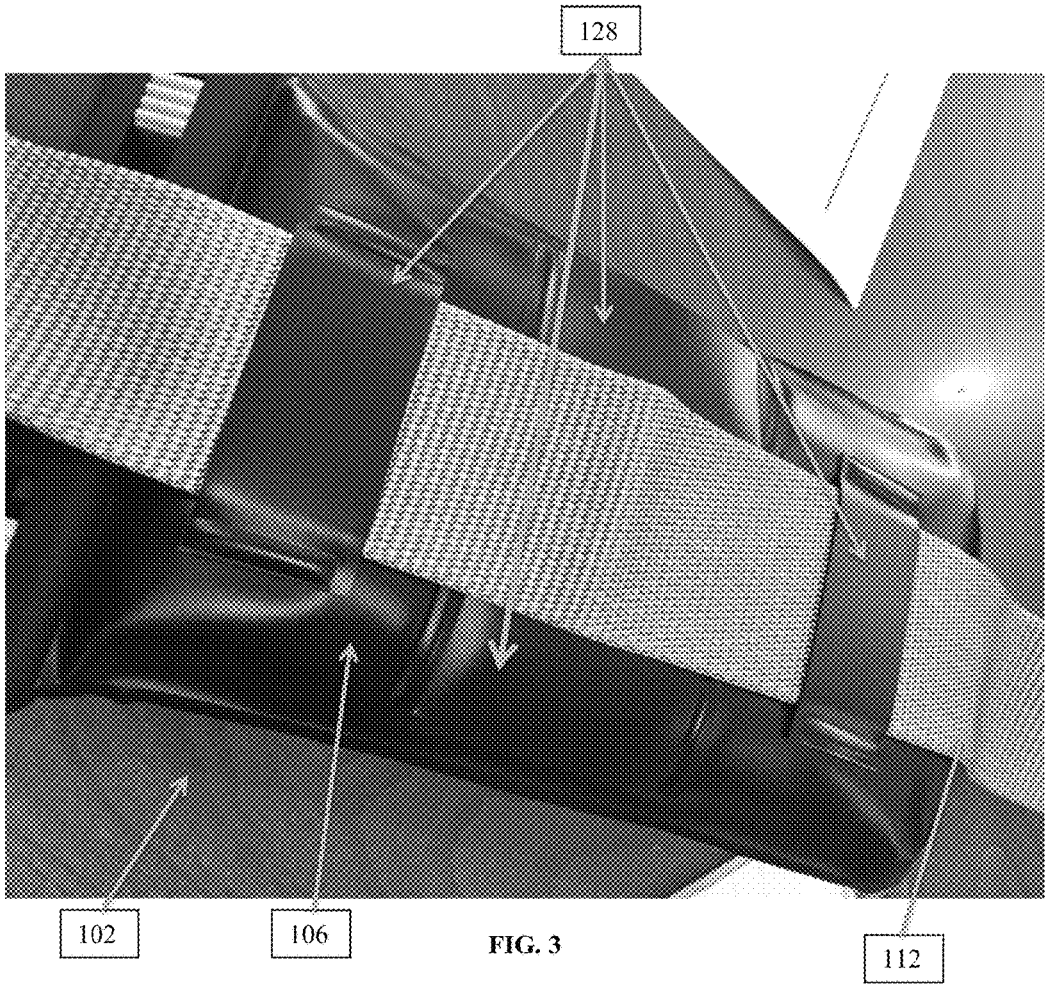

FIG. 3 provides a bottom perspective view of the device suitable for use in exemplary embodiments of this disclosure.

Figure 4:
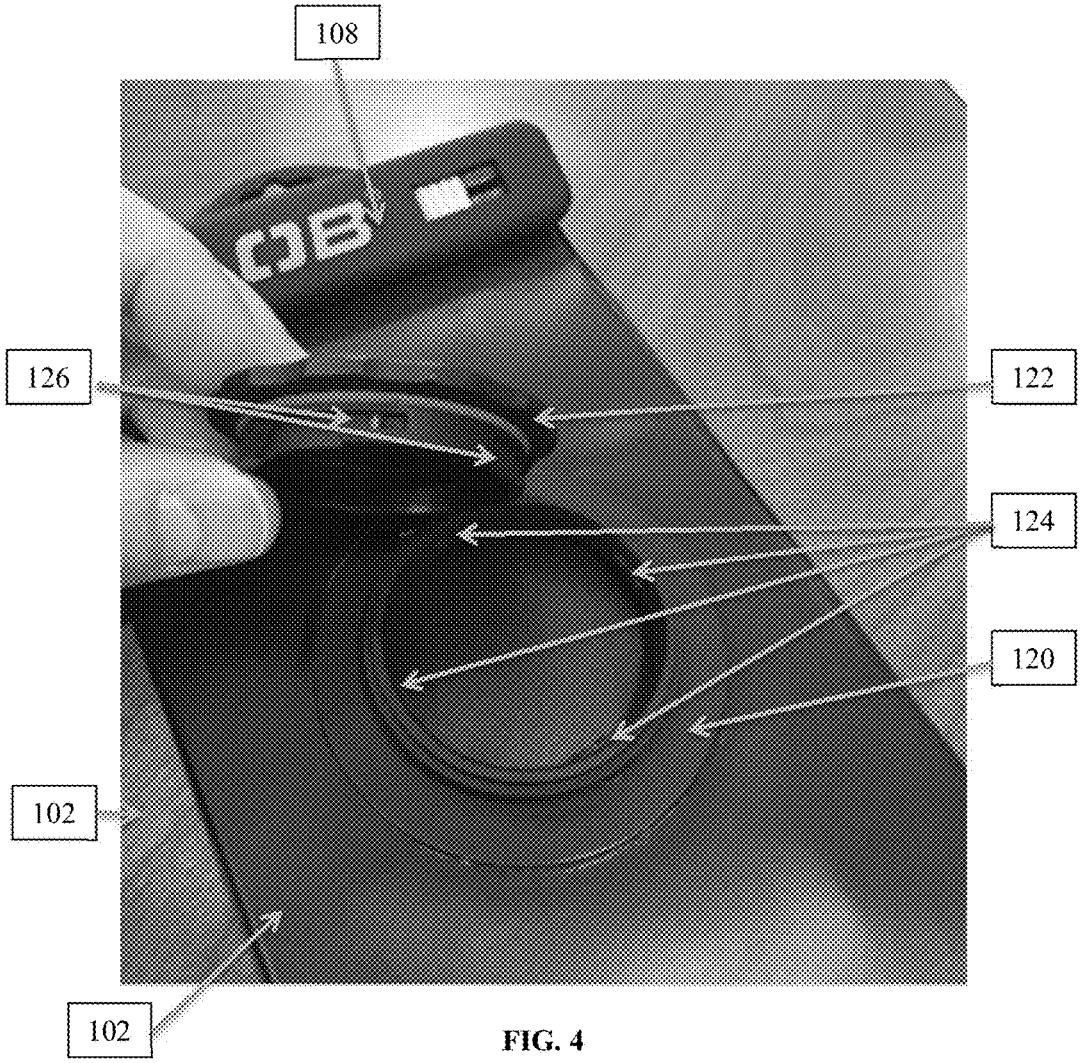

FIG. 4 provides a top view of the device suitable for use in exemplary embodiments of this disclosure.

Figure 5:
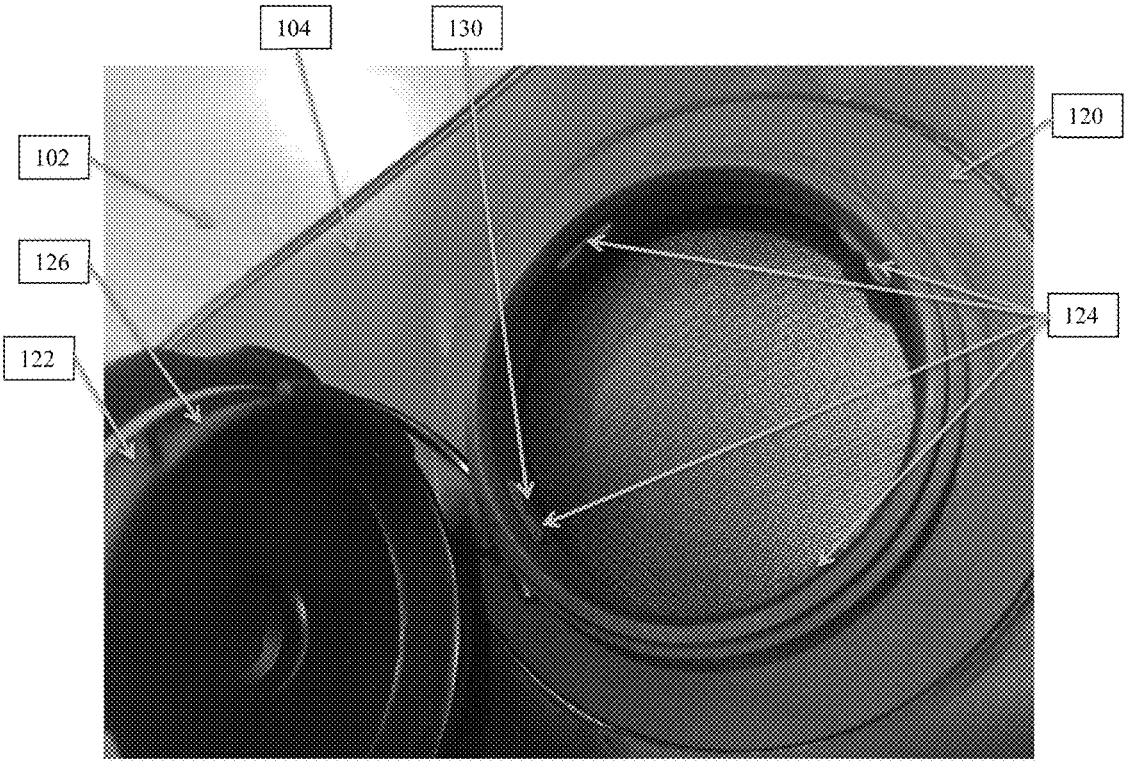

FIG. 5 provides a close-up top view of the device suitable for use in exemplary embodiments of this disclosure.

Figure 6:
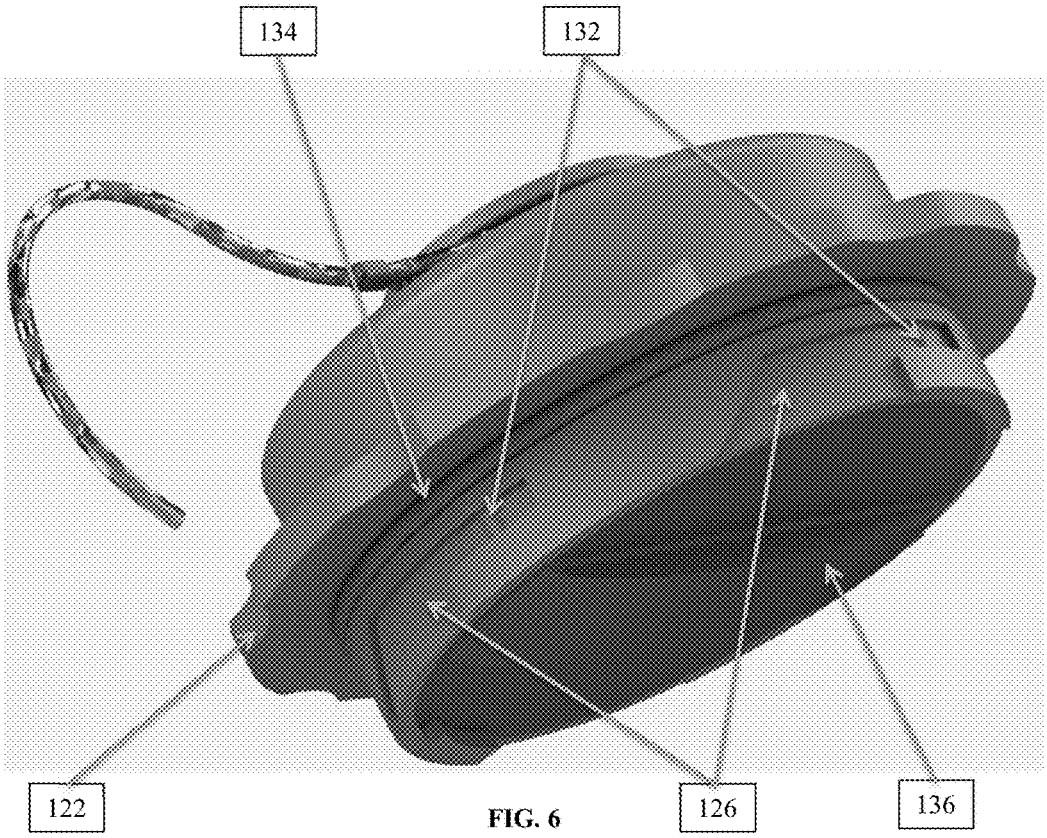

FIG. 6 provides a perspective view of an exemplary cap suitable for use in exemplary embodiments of this disclosure.

Figure 7:
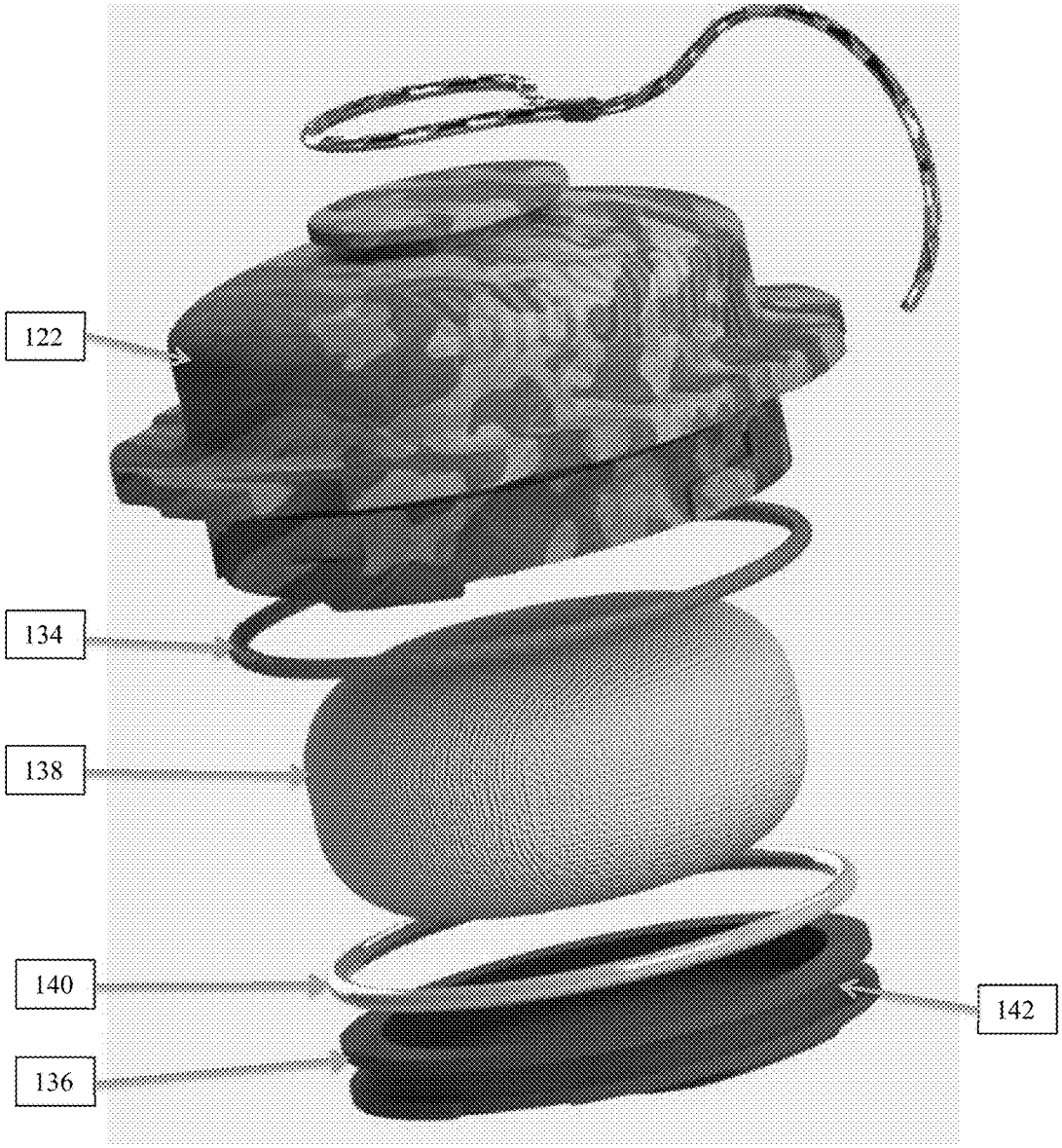

FIG. 7 provides a separated perspective view of an exemplary cap suitable for use in exemplary embodiments of this disclosure.

Figure 8:
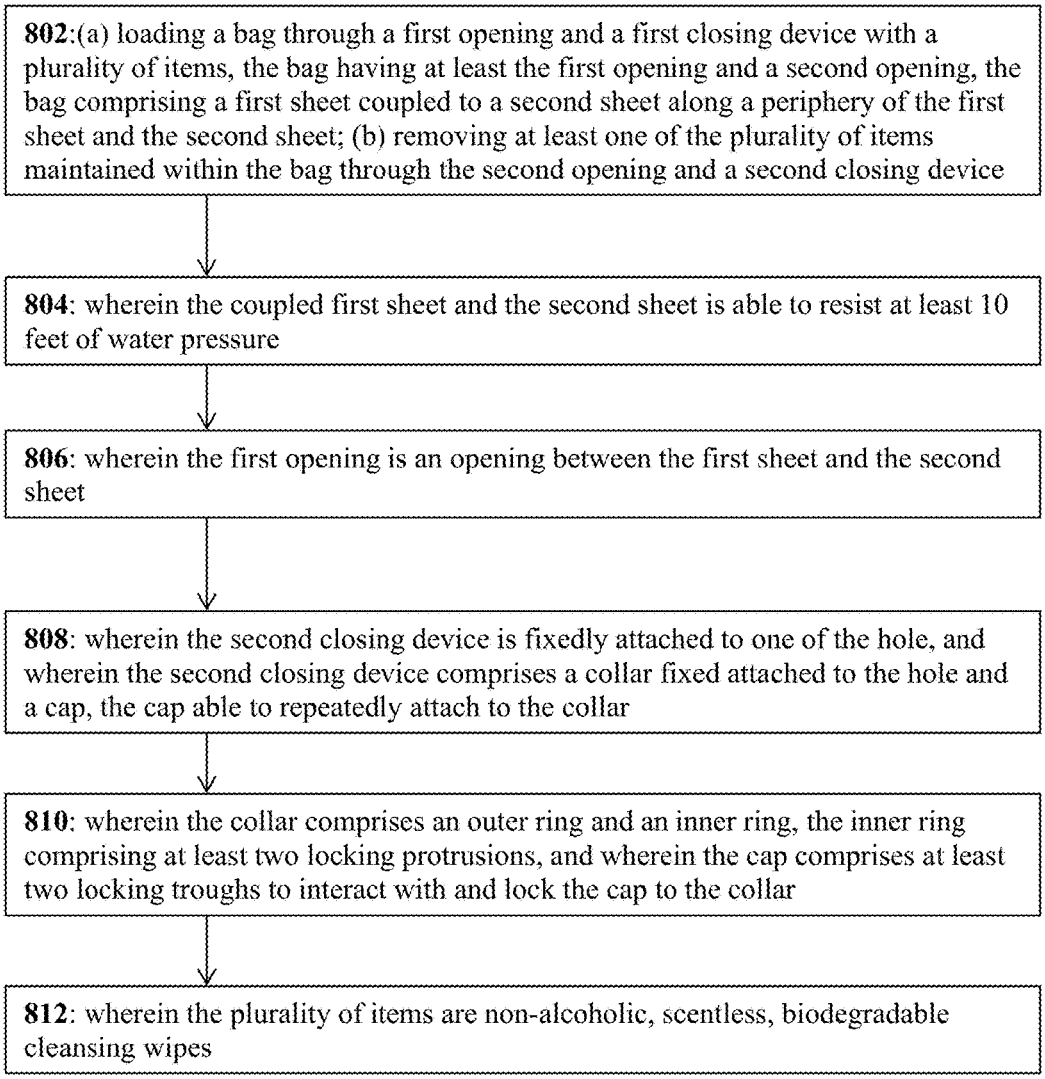

FIG. 8 provides a logic flow diagram in accordance with a method and apparatus for performing exemplary embodiments of this disclosure.

DETAILED DESCRIPTION OF THE INVENTION

Whether camping in the wilderness, trekking through the desert, or commuting through a busy urban area it is often important to maintain or have the ability to maintain one's cleanliness. Some of the current products in the marketplace which seek to solve this issue include plastic travel sized containers that are able to contain an alcohol gel based instant hand sanitizer, and disposable baby wipes soaked in a chlorine or alcohol based solution.

However, each of the available solutions have their own draw backs which include portability, susceptibility to water and the elements (e.g., water, dirt, rain, wind), and reusability. Accordingly, there is a need for a device that is able to repeatedly provide sanitary items, wherein the device is portable, air tight, reusable, and resistant to water and other elements.

Embodiments of the present disclosure provide a device and a method of using the device, which is portable, resistant to water and the elements, and can repeatedly provide sanitary items to a user as desired. Embodiments of the present disclosure further provide a device that is also rugged such that it can provide a toughness that prevents, for example, ripping, tearing, or breaking. Embodiments of the present disclosure are operable for military use.

Reference is made to FIG. 1, which provides a top perspective view of a device suitable for use in exemplary embodiments of this disclosure. Shown in FIG. 1 is device 102 including a bag made of a first sheet 104, second sheet 106 (shown in FIG. 3), a first closing element 108 (or first closing device), second closing element 110 (or second closing device), and strap 112.

Second sheet 106 is not shown in FIG. 1 but is located on the opposite side of first sheet 104. The first sheet 104 and the second sheet 106 are coupled to each other along their periphery such that a hollow pocket is formed between first sheet 104 and second sheet 106. The first sheet 104 and the second sheet 106 may be coupled through welding, an adhesive or melting the parts together. In another embodiment, first sheet 104 and second sheet 106 are formed such that they are one continuous sheet, such as through blow molding. The first sheet 104 and the second sheet 106 may be coupled in any fashion such that they provide a water tight seal between first sheet 104 and second sheet 106 at the site of the coupling. Embodiments of first sheet 104 and second sheet 106 are made of a plastic or plastic composite that is, but is not limited to, waterproof. In other words, first sheet 104 and second sheet 106 prohibit water from passing through its surface. In another embodiment, first sheet 104 and second sheet 106 are also air tight, prohibiting the passing of air through its surface. Embodiments of first sheet 104 and second sheet 106 including the sections wherein first sheet 104 is coupled to second sheet 106 have a certain toughness that provides a resistance to cuts, tearing, ripping, scratching, and braking.

In the embodiment shown in FIG. 1, first sheet 104 and second sheet 106 (shown in FIG. 3) are coupled together throughout their periphery except the portions of first sheet 104 and second sheet 106 which are coupled to first closing element 108. First closing element 108 is fixedly coupled to first sheet 104 and second sheet 106 along the portion of the periphery of first sheet 104 and second sheet 106 that are not coupled to one another, providing a passage to the hollow pocket between first sheet 104 and second sheet 106. However, it should be appreciated that embodiments include first closing element 108 being removeably coupled to first sheet 104 and second sheet 106.

It should be appreciated that while device 102 is described and depicted in FIG. 1 as having a first sheet 104 and a second sheet 106, embodiments of device 102 include a single sheet or bag like configuration with a hollow pocket or multiple sheets that are coupled to form a hollow pocket.

First closing element 108 is able to repeatedly allow the passage between first sheet 104 and second sheet 106 to be opened and sealed. Embodiments of first closing element 108 are able to seal the passage between first sheet 104 and second sheet 106 such that it prohibits the leaking of water and other elements into the hollow pocket. In one embodiment, first closing element 108 is waterproof to a maximum depth of 20 feet of water. In another embodiment, first closing element 108 is waterproof to a maximum depth of 10 feet of water.

First closing element 108 includes a top part 114, a bottom part 116, and two slides 118 for sealing and maintaining the first closing element 108 in the sealed or closed position. Top part 114 is coupled to first sheet 104, and bottom part 116 is coupled to second sheet 106. Slides 118 as shown in FIG. 1 are moveably coupled to bottom part 116 and are operable to slide laterally along the long axis of first closing element 108 within first closing element 108. Slides 118 are able to slide from an unlocked position to a locked position pressing and sealing top part 114 and bottom part 116 together and thereby sealing the passage between first sheet 104 and second sheet 106. In the locking position, slides 118 are able to clasp a portion of top part 114 and compress top part 114 and bottom part 116 together creating a seal. For example, in one embodiment, slides 118 can include a tilted plane that can slide over a portion of the top part 114. The tilted plane will urge or press the portion of the top part 114 that comes into contact with slide 118 with more and more force as slide 118 is moved farther in the closed or sealed position.

Second closing element 110 as depicted in FIG. 1 is coupled to first sheet 104. However, embodiments of second closing element 110 can be coupled to either first sheet 104 or second sheet 106 to provide a repeatedly sealable passage to the hollow pocket between the first sheet 104 and the second sheet 106. Second closing element 110 includes a collar 120 and a cap 122. Collar 120 is coupled to first sheet 104 along the periphery of collar 120. Collar 120 has a hollow (or open) center and provides a passage through first sheet 104 to the hollow pocket between first sheet 104 and second sheet 106.

Embodiments of collar 120 are fixedly coupled to first sheet 104 such that it is both resistant to leaking water or other elements. In one embodiment, collar 120 and first sheet 104 are able to prohibit the passage of water or other elements up to 20 feet of water pressure. Cap 122 can be repeatedly affixed to collar 120 to cover and seal the hollow center of collar 120 to prevent the passage of water or other elements into the hollow pocket. Embodiments of cap 122 include any type of lid, cover, top, or closure that is able to removeably affix to collar 120 as described herein. In one embodiment, cap 122 is removeable from collar 120 one-time and cannot be reattached. In another embodiment, cap 122 can be repeatedly removed and reattached to collar 120.

In one embodiment, collar 120 includes a plurality of protrusions 124 (including ribs or engageable features) along its inside surface extending into its hollow center for interacting and removeably coupling to cap 122. Cap 122 includes a plurality of troughs 126 along an outside surface for interacting and removeably coupling cap 122 to collar 120 by protrusions 124. Troughs 126 include an inclined portion for urging or ramping cap 122 into either the open or sealed position depending upon the desired movement of cap 122 relative to collar 120.

Device 102 includes line 124 moveably coupled to cap 122 and collar 120. Embodiments of line 124 are able to maintain cap 122 in a nearby location relative to collar 120 when cap 122 is detached or removed from covering collar 120.

Strap 112 is removeably and moveably coupled to second sheet 106. Embodiments of strap 112 include strap 112 being removeably and moveably coupled to either first sheet 104 or second sheet 106 or both first sheet 104 and second sheet 106. Embodiments of strap 112 include a buckle of attachment mechanism for securing or coupling strap 112 and device 102 to a user or other device.

In practice, device 102 is operable to maintain within the hollow pocket multiple sanitary wipes or napkins soaked by or moist with a sanitizing solution. A plurality of sanitary wipes can be placed within the hollow pocket through the first closing element 108. Then first closing element 108 and collar 120 and cap 122 can be sealed thereby sealing the sanitary wipes within the hollow pocket preventing or substantially slowing the natural drying process of the sanitary wipes. In one embodiment, device 102 can be loaded with a packet with an opening corresponding to the hollow center of collar 120, wherein the packet is a plastic packet having a plurality of sanitary wipes within the packet. It should be appreciated that embodiments of device 102 are also able to maintain or hold any type of item that is sized to fit into device 102, including electronic devices, water, tools, towels, tissues, napkins, and the like.

After device 102 is loaded with sanitary wipes, the wipes can be accessed individually or in groups through collar 120 and cap 122. A user, when desired, can remove cap 122 from collar 120 to allow access to hollow center and the hollow pocket to obtain as many sanitary wipes as desired. Device 102 when first closing element 108 and collar 120 and cap 122 are in a closed or sealed position prohibits the passage of water and other elements to the hollow pocket and likewise prohibits the passage of water or other fluids from the hollow pocket to an exterior of device 102.

Embodiments of sanitary wipes provide an antibacterial, antimicrobial, and antiviral solution. Embodiments of sanitary wipes are also biodegradable, and can have a specific scent or can have no scent.

Reference is now made to FIG. 2, which provides another top perspective view of the device suitable for use in exemplary embodiments of this disclosure. Shown in FIG. 2 is device 102 with first sheet 104, first closing element 108 including top part 114, bottom part 116, and two slides 118. Also shown in FIG. 2 is collar 120 and cap 122.

First closing element 108 as depicted in FIG. 2 is in an open position allowing passage to the hollow pocket between first sheet 104 and second sheet 106. First sheet 104 is coupled to top part 114 of the first closing element 108, and second sheet 106 is coupled to bottom part 116 of the first closing element 108. However, it should be appreciated that embodiments of first closing element 108 including top part 114 and bottom part 116 include any configuration that allows first closing element 108 to repeatedly open and seal first sheet 104 and second sheet 106 prohibiting passage of water and other elements into the hollow pocket.

As shown in FIG. 2, slides 118 are slideably coupled to bottom part 116 and are able to slideably lock, clamp, or clasp top part 114 to bottom part 118. It should be appreciated that embodiments of slides 118 can be slideably coupled to either top part 114 or bottom part 116 provided that they are able to repeatedly open and seal bottom part 116 and top part 114 of first closing element 108 together thereby sealing first sheet 104 and second sheet 106 to occlude passage to the hollow pocket.

Referring to FIG. 3, shown is a bottom perspective view of the device suitable for use in exemplary embodiments of this disclosure. Shown in FIG. 3 is device 102 with second sheet 106 and strap 112. As depicted in FIG. 3, strap 112 is moveably attached to second sheet 106 through feeds 128. Strap 112 as shown in FIG. 3 is moveably attached to second sheet 106 through two feeds 128. However, device 102 includes multiple feeds 128 for positioning and moveably attaching strap 112 to second sheet 106 as is desired by a user. It should be appreciated that embodiments of strap 112 include strap 112 being fixedly attached to second sheet 106 or first sheet 104 or a combination of both.

Each feed 128 are fixedly coupled to second sheet 106 along their lateral ends thereby providing a hollow passage through and between second sheet 106 and feed 128. It should be appreciated that embodiments of feeds 128 provide a means for moveably attaching strap 112 to device 102. Embodiments of feeds 128 can be located on either first sheet 104, or second sheet 106.

Reference is now made to FIG. 4, which presents a top view of the device suitable for use in exemplary embodiments of this disclosure. Shown in FIG. 4 is device 102 with first sheet 104, first closing element 108, collar 120, and cap 122. Also shown in FIG. 4 are protrusions 124 and troughs 126. protrusions 124 are located along an inside surface of collar 120 extending into its hollow center for interacting and removeably coupling to cap 122. Troughs 126 are located on an outside surface of cap 122 for interacting and removeably coupling cap 122 to collar 120 by protrusions 124.

It should be appreciated that embodiments of protrusions 124 and troughs 126 include any configuration that allow cap 122 to be removeably attached to collar 120 thereby providing a water and other element tight seal between cap 122 and collar 120.

Referring to FIG. 5, shown is a close-up top view of the device suitable for use in exemplary embodiments of this disclosure. Shown in FIG. 5 is device 102, first sheet 104, collar 120, cap 122, protrusions 124, and troughs 126. As shown in FIG. 5, protrusions 124 each provide a raised bar on the surface of the inside of collar 120. Embodiments of protrusions 124 as shown in FIG. 5 can include a divot 130 for interacting with troughs 126 and lip 132 (shown in FIG. 6) within troughs 126 to provide a mechanism to inhibit rotation of cap 122 relative to collar 120.

In the embodiment shown in FIG. 5, cap 122 is sized to interact with collar 120 to secure a portion of cap 122 within collar 120. However, embodiments of the present disclosure include a cap 120 sized to be secured to collar 120. It should also be appreciated that embodiments of protrusions 124 can be located on cap 122 and embodiments of troughs 126 can be located on collar 120.

Turning to FIG. 6, shown is a perspective view of a cap suitable for use in exemplary embodiments of this disclosure. Shown in FIG. 6 is cap 122 with troughs 126, lips 132, O-ring 134, and bottom cap 136. Embodiments of lips 132 provide a raised portion of troughs 126 to fit into or interact with divot 130 (shown in FIG. 5) on protrusions 124 in collar 120, thereby providing pressure between lips 132 and divot 130 to aid in maintaining cap 122 and collar 120 in a closed position.

O-ring 134 provides a rubber or rubber like ring for aiding a water tight and/or element tight seal between cap 122 and collar 120. Embodiments of O-ring 134 are sized and located on cap 122 such that O-ring 134 is compressed between cap 122 and collar 120.

Embodiments of cap 122 include a hollow port on the underside of cap 120. Bottom cap 136 is moveably attached to cap 122 to occlude passage to the hollow port. Embodiments of bottom cap 136 are able to be repeatedly released and sealed to cap 122 to provide either access to hollow port or to create a water tight seal between cap 122 and bottom cap 136.

Reference is now made to FIG. 7, which depicts a separated perspective view of an exemplary cap suitable for use in exemplary embodiments of this disclosure. Shown in FIG. 7 is cap 122, O-ring 134, powder ball 138, bottom O-ring 140, and bottom cap 136.

Powder ball 138 is a solid powder that has been compressed into a ball or other shape that can fit into hollow port of cap 122. Embodiments of powder ball 138 can be comprised of chalk or other powder capable of drying or absorbing moisture. Embodiments of powder ball 138 include any type of self-contained dispensable material such as powders, balms, ointments, lotions or the like. It should be appreciated that embodiments of cap 122 are able to maintain any type of item that is sized to fit within the hollow port. For example, the hollow port of cap 122 may be able to maintain contact lenses, lip balm, pills, medicine, creams, liquids, powders, tools, and the like.

Bottom O-ring 140 is sized to fit within channel 142 of bottom cap 136 for aiding to maintaining a seal between cap 122 and bottom cap 136 when bottom cap 136 is in a closed or sealed position. Embodiments of bottom O-ring 140, bottom cap 136 and cap 122 are able to repeatedly open and seal hollow port of cap 122 such that water and other elements are prohibited from passing between cap 122 and bottom cap 136.

Referring to FIG. 8, presented is a logic flow diagram in accordance with a method and apparatus for performing exemplary embodiments of this disclosure. Block 802 presents (a) loading a bag through a first opening and a first closing device with a plurality of items, the bag having at least the first opening and a second opening, the bag comprising a first sheet coupled to a second sheet along a periphery of the first sheet and the second sheet; (b) removing at least one of the plurality of items maintained within the bag through the second opening and a second closing device. Then block 804 presents wherein the coupled first sheet and the second sheet is able to resist at least 10 feet of water pressure.

Some of the non-limiting implementations detailed above are also summarized at FIG. 8 following block 804. Block 806 specifies wherein the first opening is an opening between the first sheet and the second sheet. Then Block 808 states wherein the second closing device is fixedly attached to one of the hole, and wherein the second closing device comprises a collar fixed attached to the hole and a cap, the cap able to repeatedly attach to the collar. Block 810 then indicates that wherein the collar comprises an outer ring and an inner ring, the inner ring comprising at least two locking protrusions, and wherein the cap comprises at least two locking troughs to interact with and lock the cap to the collar. Block 812 then relates to wherein the plurality of items are non-alcoholic, scentless, biodegradable cleansing wipes.

This disclosure has been described in detail with particular reference to a presently preferred embodiment, but it will be understood that variations and modifications can be effected within the spirit and scope of the disclosure. The presently disclosed embodiments are therefore considered in all respects to be illustrative. The scope of this disclosure is indicated by the appended claims, and all changes that come within the meaning and range of equivalents thereof are intended to be embraced therein.

The invention claimed is:

1. An apparatus comprising:

(a) a bag having at least a first opening and a second opening, the bag comprising a first sheet coupled to a second sheet along a periphery of the first sheet and the second sheet;

(b) a first closing device coupled to the first opening, the first closing device able to repeatedly open and seal the first opening; and (c) a second closing device coupled to the second opening, the second closing device able to repeatedly open and seal the second opening;

wherein the first sheet and the second sheet are able to resist at least 10 feet of water pressure.

2. The apparatus according to claim 1, wherein the first opening is a passage between the first sheet and the second sheet.

3. The apparatus according to claim 2, wherein the first closing device is fixedly attached to the first sheet and the second sheet, and wherein the first closing device is able to repeatedly open and seal the first opening to resist at least 10 feet of water pressure.

4. The apparatus according to claim 3, wherein the second opening is a hole in one of the first sheet or the second sheet.

5. The apparatus according to claim 4, wherein the second closing device is fixedly attached to a periphery of one of the first sheet or the second sheet around the hole, and wherein the second closing device comprises a cap and a collar fixed attached to one of the first sheet or the second sheet around the hole, the cap able to repeatedly attach to the collar.

6. The apparatus according to claim 5, wherein the collar comprises an outer ring and an inner ring, the inner ring comprising at least two locking protrusions, and wherein the cap comprises at least two locking troughs to interact with the at least two locking protrusions and lock the cap to the collar.

7. The apparatus according to claim 2, wherein the first closing device is removably attached to the first sheet and the second sheet.

8. A method comprising:

(a) loading a bag through a first opening and a first closing device with a plurality of items, the bag having at least the first opening and a second opening, the bag comprising a first sheet coupled to a second sheet along a periphery of the first sheet and the second sheet; and (b) removing at least one of the plurality of items maintained within the bag through the second opening and a second closing device, wherein the first sheet and the second sheet are able to resist at least 10 feet of water pressure.

9. The method according to claim 8, wherein the first opening is between the first sheet and the second sheet.

10. The method according to claim 9, wherein the second closing device comprises a collar fixed attached to the bag and a cap, the cap able to repeatedly attach to the collar.

11. The method according to claim 10, wherein the collar comprises an outer ring and an inner ring, the inner ring comprising at least two locking protrusions, and wherein the cap comprises at least two locking troughs to interact with and lock the cap to the collar.

12. The method according to claim 11, wherein the plurality of items are non-alcoholic, scentless, biodegradable cleansing wipes.

13. An apparatus comprising:

(a) a first sheet surface;

(b) a second sheet surface, a portion of a periphery of the first sheet surface and the second sheet surface coupled together to define an open pocket between the first sheet surface and the second sheet surface, and wherein a portion of the periphery of the first sheet surface and the second sheet surface is not coupled together defining a passage to the open pocket;

(c) a port on one of the first sheet or the second sheet, the port including a collar with at least two locking protrusions, the port defining a second passage to the open pocket;

(d) a cap, the cap having a ring with locking troughs for locking with the at least two locking protrusions, the collar and the cap able to repeatedly open and seal the second passage; and (e) a closing device, the closing device coupled to the first sheet surface and the second sheet surface, the closing device able to repeatedly open and seal the passage.

14. The apparatus according to claim 13, wherein the sealed position of the closing device, and the cap with the collar is able to maintain their seal to resist at least 10 feet of water pressure.

15. The apparatus according to claim 13, wherein the first sheet surface, the second sheet surface, the collar, the cap, and the closing device are non-reflective materials.

16. An apparatus comprising:

(a) a container having a hollow center and flexible opposing walls, the container having a first opening and a second opening, the first opening and the second opening providing a passage to the hollow center;

(b) a first closure device coupled to the first opening, the first closure device operable to open and seal the first opening;

(c) a second closure device coupled to the second opening, the second closure device operable to open and seal the second opening;

wherein the container, the first closure device in a sealed position, and the second closure device in a sealed position are able to resist at least 10 feet of water pressure.

17. The apparatus according to claim 16, wherein the first closure device comprises a cap and a collar, the collar fixedly attached to the first opening, the cap operable to repeatedly attach to the collar and seal the first opening.

* * * * *